United States Patent [19]

Svendsen et al.

[11] 4,000,520

[45] Jan. 4, 1977

[54] HEADGEAR SUPPORT SYSTEM

[75] Inventors: Noel A. Svendsen, Bedford; Willard G. Sylvester, Concord, both of Mass.

[73] Assignee: Arthur D. Little, Inc., Cambridge, Mass.

[22] Filed: Mar. 21, 1975

[21] Appl. No.: 561,008

[52] U.S. Cl. ..... 2/418

[51] Int. Cl.[2] ..... A42B 3/00

[58] Field of Search ..... 2/3 R, 3 A, 3 B, 3 C, 2/209

[56] References Cited

UNITED STATES PATENTS

| | | | |
|---|---|---|---|
| 2,814,043 | 11/1957 | Alesi | 2/3 R |
| 3,354,468 | 11/1967 | Bowers | 2/3 R |
| 3,845,505 | 11/1974 | Davison et al. | 2/209 |

*Primary Examiner*—George H. Krizmanich
*Attorney, Agent, or Firm*—Schiller & Pandiscio

[57] ABSTRACT

Described is an improved headgear support of the internal suspension system type for supporting the head in spaced relation within a rigid headpiece. The improvement comprises an elongated nape strap disposed adjacent the rear portion of the headpiece for contacting the nape of the wearer's neck. Each end of the nape strap is disposed adjacent respective opposite sides of the headpiece. Means are provided for tensioning the nape strap and for locking the nape strap in a tensioned state so that the wearer's head can be locked within the headpiece between the suspension and the nape strap. In one embodiment of the invention, the tensioning and locking means comprises a lever arm-ratchet bar assembly and in another embodiment, the tensioning and locking means comprises a spool assembly.

5 Claims, 7 Drawing Figures

HEADGEAR SUPPORT SYSTEM

This invention relates to headgear and more particularly to protective headgear support systems.

A variety of different types of protective headgear are used for military, construction, driving and other like purposes. Many of these headgear include a rigid headpiece and a support system for supporting the headpiece in spaced relation to the wearer's head. The term "headpiece" as used herein is any rigid protective or defensive covering for the head. In some headgear, such as may be used on construction sites and in some sports, the headpiece is a rigid protective shell which is usually made of a hard, but light-weight material. Other headgear, such as the U.S. Government M-1 helmet currently used by the military, are provided with a metallic shell or pot which is relatively heavy and used only for particular purposes, such as combat. Since it is often not necessary to use the metallic shell, these military headgear are usually provided with a hard, relatively light-weight liner. The latter is formed so that the metallic shell covers or is nested with the liner when it is desirable to use the shell, and removed when it is desirable to use only the liner.

Various systems are known for supporting these shells and liners. One such support system which is currently used in the M-1 helmet comprises a liner-mounted, six-point cradle snap-in suspension of adjustable fabric straps which fit around and over the top of the head. Another strap, the nape strap intended to fit beneath the rear protuberance of the head, is riveted to the glass-reinforced phenolic laminate liner. Chin straps are fastened to the metal shell and are presently designed to encircle around, rather than underneath the chin. However, the present support system allows the relatively heavy shell and liner to swing about in practically infinite degrees of freedom, especially when the chin strap is unfastened, and results in a condition of unbalance and discomfort to the wearer.

It is therefore an object of the present invention to provide an improved system for supporting a headpiece in spaced relation with the head which overcomes the aforementioned problems.

Another object of the present invention is to provide an improved support system for protective headgear which increases the relative stability of the headgear on the head as compared to prior art support systems.

Still another object of the present invention is to provide an improved support system for locking the wearer's head to a headgear suspension.

These and other objects are achieved by a headgear support system of the type having a suspension subassembly in which the improvement comprises a nape strap disposed adjacent the rear portion of a headpiece for contacting the nape of the wearer's neck. Each end of the nape strap is disposed adjacent respective opposite sides of the headpiece. Means are provided for tensioning the nape strap and for locking the nape strap in a tensioned state so that the wearer's head can be locked within the headpiece between the suspension and the nape strap.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

In the drawings, the same numerals will refer to like parts.

Figure 1:
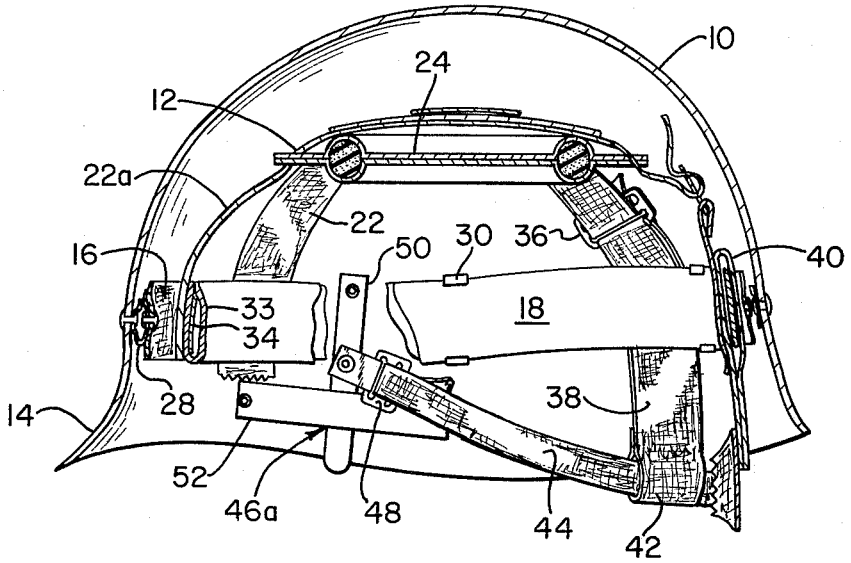
FIG. 1 is a longitudinal sectional view through one embodiment of the present invention.

In FIGS. 1, 2, 4 and 5, rigid headpiece 10 is provided with a support system 12 for supporting the headpiece in spaced relation to the wearer's head. The headpiece is formed with a lip or brim 14 which usually defines the front of the headpiece. Headpiece 10 is preferably made of any rigid material. For example, it can be made of a hard polymer plastic such as some of the various acrylics or it can be made of a metal or metal alloy such as a steel. Accordingly, headpiece 10 can be either a protective shell or it can be a liner such as the glass-reinforced liner utilized in the M-1 helmet system.

Support system 12 as illustrated, includes a suspension subassembly which is similar to the type currently employed in the M-1 helmet. Generally, the subassembly comprises a peripheral band 16 for attaching the subassembly to headpiece 10 and a six-point cradle suspension for maintaining the wearer's head in spaced relation to the headpiece. The suspension comprises circular perspiration or sweat band 18 and three crossed cradle leg straps 22. The ends of each of cradle leg straps 22 are located at opposite sides of the headpiece. The straps intersect at crown cushion 24 at the top of the suspension. Peripheral band 16 is attached to headpiece 10 at a plurality of points around the periphery of the headpiece by suitable means such as rivet assembly 28. The latter includes a rivet which extends through the headpiece at each attachment point, through a rivet clip and is pivotally secured to a grommet provided in peripheral band 16. Further, support system 12 can be made removable from headpiece 10 by modifying assembly 28 to include male and female snap fitting elements as well known in the art.

Perspiration band 18 is removably attached to peripheral band 16 by clips 30. Preferably, each end of band 18 is connected to buckle 32 so that the size of the perspiration band can be adjusted as well known in the art. Band 18 is preferably covered with facing material 33, such as leather, for absorbing perspiration form the user's head. Additionally, in order to keep the perspiration band flat against the user's head and to prevent band "rollover" or curling after repeated use, the facing material may be provided with underlayer 34 of urethane foam having a very thin coating, e.g. 20 mils thick, of a polycarbonate resin. The latter may be any type of a thermoplastic carbonatelinked polymer such as the material produced by the General Electric Co., of Schenectady, New York under the trademark "Lexan".

Figure 2:
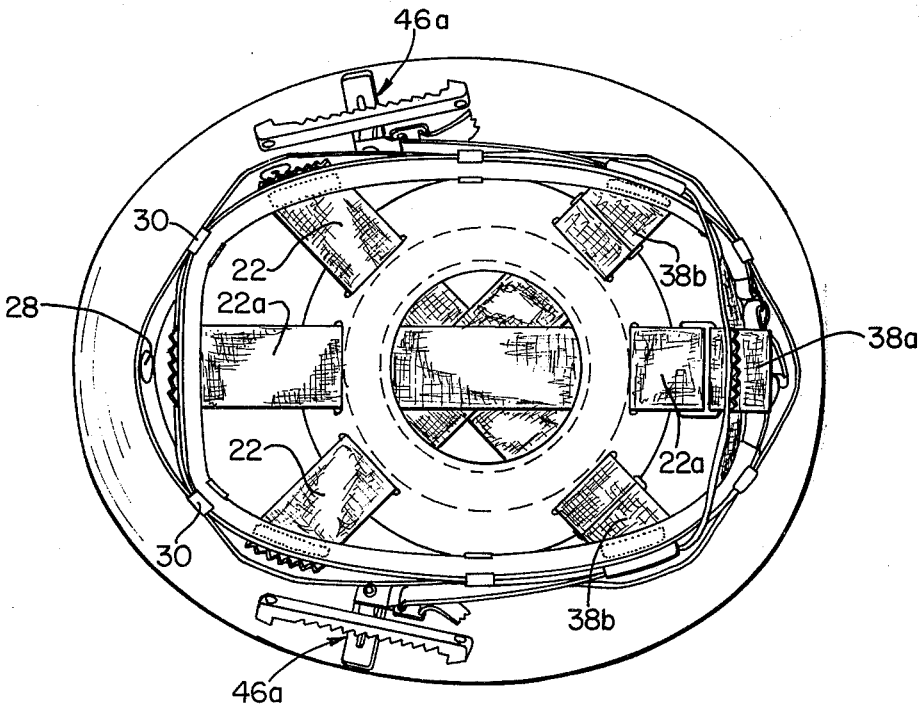
FIG. 2 is a bottom view of the FIG. 1 embodiment.
Figure 3:
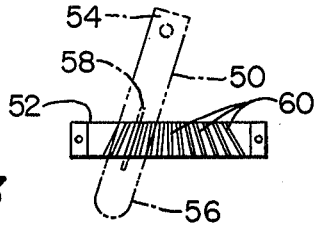
FIGS. 3 is a side view, partially in phantom, of the nape strap tensioning and locking means of the FIG. 1 embodiment.
Figure 4:
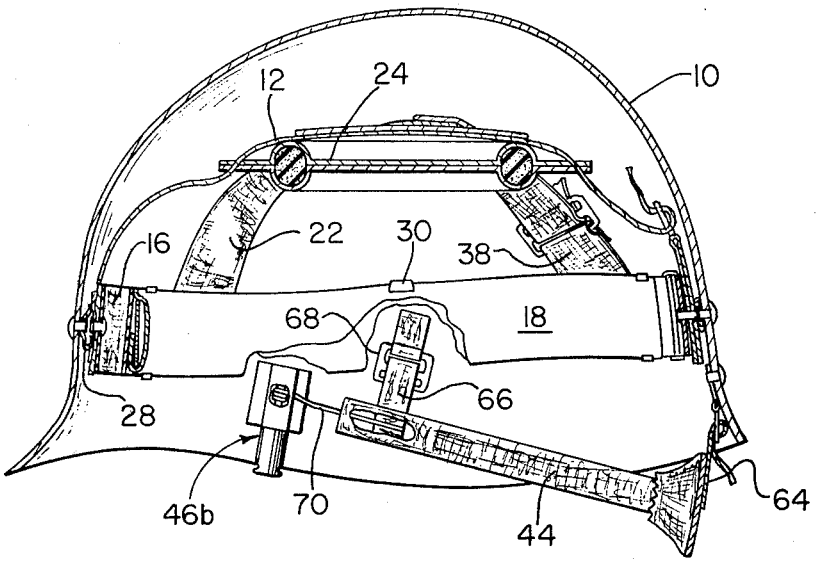
FIG. 4 is a longitudinal-sectional view taken through a second embodiment of the present invention.
Figure 5:
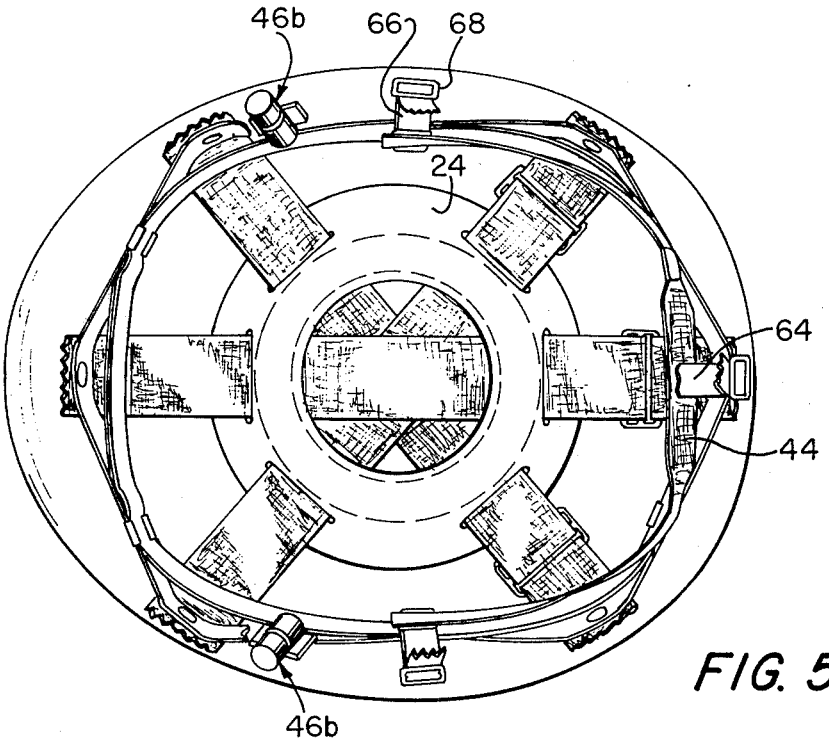
FIG. 5 is a bottom view of the FIG. 4 embodiment.

Referring to FIGS. 1–3, three straps 22 of the cradle suspension are oriented in a manner well known in the art. The front end of each strap is secured to perspiration band 18. Each strap extends through slots provided in crown cushion 24. Cushion 24 helps to keep the cradle straps evenly spaced and distribute the downward load or other force over a relatively greater surface area. Cushion 24 preferably comprises a core of closed cell, polyvinyl chloride foam (typically having a density of about two lbs/ft$^3$) which is covered with leather. Alternatively, cushion 24 may be removed and a loop (not shown) can be provided on the top of saqittal strap 22*a* as currently provided in the M-1 suspension system. Straps 22 terminate at adjustment buckles 36 at a point toward the rear of the headpiece above the perspiration band. Buckles 36 allow the length of each of straps 22 to be adjusted to accommodate different size heads. Extension strap 38 is secured at one end to each buckle to extend the suspension provided by each cradle leg strap 22 to the rear of headpiece 10. Each extension strap 38 is secured intermediate its ends to perspiration band 18 and is secured at its lower end, below perspiration band 18, to elongated nape strap 44. Sagittal strap 38*a* is provided with sling 40 which slidably supports perspiration band 18 while the remaining two straps 38*b* are preferably affixed to band 18. The sagittal strap 38*a* is affixed to nape strap 44 while straps 38*b* are provided with slings 42 at their lower ends for slidably supporting nape strap 44.

Nape strap 44 is disposed around the rear of headpiece 10, so as to contact the nape of the wearer's neck when the headpiece is worn. The ends of nape strap 44 are each disposed at respective adjacent sides of the headpiece and connected to a tensioning and locking assembly 46*a* by suitable means such as buckle 48. Buckle 48 receives the nape strap so that the latter can be adjusted to fit different size heads. Tensioning and locking assembly 46*a* provides means for tensioning and locking the nape strap in a tension state.

As shown in greater detail in FIG. 3, locking assembly 46*a* comprises a lever arm-ratchet bar assembly including side lever arm 50 which cooperates with ratchet bar 52. Lever arm 50 is pivotally mounted at one end 54 to headpiece 10, and extends transversely to both perspiration band 18 and ratchet bar 52 with its other end 56 preferably secured to the ratchet bar 52. Buckle 48 is pivotally secured to the inner surface of lever arm 50 at a point which is spaced from pivot end 54 so that pivotal movement of the lever arm about end 54 causes the ends of the nape strap to move with the arm. The outer surface of the lever arm is provided with elongated ridge or ratchet tooth 58. Tooth 58 extends generally parallel to the elongated direction of the lever and is positioned so as to contact ratchet bar 52. Ratchet bar 52 is affixed at both of its ends to headpiece 10 while its center portion is spaced from the headpiece for receiving the lever arm therebetween. The surface of the center portion of bar 52, facing the headpiece 10 and lever arm 50 are provided with a plurality of notched recesses 60 each of which receives tooth 58 when lever arm 50 is in one of a corresponding plurality of predetermined positions. Arm 50 is movable relative to bar 52 so that tooth 58 may be locked in anyone of the recesses 60 to hold the nape strap in tension. Arm 50 and bar 52 are preferably made of an acetal plastic resin, such as the material manufactured by E. I. DuPont de Nemours and Co., Inc., of Delaware under the trademark "Delrin", because of its strength, resiliency and machinability.

For optimum benefits the embodiment illustrated in FIGS. 1–3 is utilized as follows: Perspiration band 18, and cradle leg straps 22 are adjusted to provide maximum contact of band 18, straps 22 and 38 as well as crown cushion 24 with respect to the user's head. This is accomplished by adjusting band 18 and straps 22 through buckles 32 and 36, respectively, in a manner well known in the art. Both side lever arms 50 are pivoted toward the rear of the headpiece to an unlocked position. Nape strap 44 is coarsely adjusted through buckles 48 to provide loose contact with the nape of the neck of the wearer in a comfortable manner. In this unlocked position, the headpiece can easily be placed on and taken off the head without difficulty. When it is desirable to secure the headpiece so that the suspension system is virtually locked on the wearer's head, end 56 of each side lever arm 50 is moved sidewise toward headpiece 10 a sufficient amount to disengage ratchet tooth 58 from notches 60 of ratchet bar 52, and simultaneously the end is moved to a forward position in order to tension the nape strap. When the desired tension is achieved, end 56 of lever arm 50 is released so that tooth 58 engages nearest notch 60 from the rearward direction. Since the nape strap is in tension and the lever arm is resilient, tooth 58 will be locked in the notch, thereby locking the head in the suspension. In this tensioned and locked state, headpiece 10 is stable on the wearer's head.

Various modifications can be made to the embodiment shown in FIGS. 1–3. Referring to the embodiment shown in FIGS. 4–7, the support system 12 is attached to headpiece 10 so that the front end of each of straps 22 (which extend through crown cushion 24) as well as the rear end of each extension strap 38 are all connected to the peripheral band 16 and to headpiece 10 by rivet assembly 28 to provide the six-point cradle suspension system. Perspiration band 18 is attached to peripheral band 16 by clips 30. Nape strap 44 is provided with rear strap 64 and two side straps 66. Each of straps 64 and 66 are adjustably secured to headpiece 10 by suitable means such as buckles 68. The ends of nape strap 44 are each connected to the tensioning and locking means 46*b* by cord 70. The latter is attached to the nape strap in any suitable manner such as sewing or the like. The cord preferably is a polyvinyl-coated braided nylon cord to provide maximum strength or any other cable of suitable tensile strength and flexibility.

Figure 6:
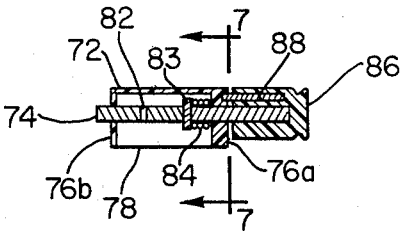
FIG. 6 is a longitudinal-sectional view of the nape strap tensioning and locking means of the FIG. 4 embodiment.
Figure 7:
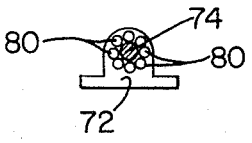
FIG. 7 is a cross-sectional view taken aong line 7—7 of FIG. 6.

Locking assembly 46*b*, shown in greater detail in FIGS. 6 and 7, comprises a spool assembly having housing 72 for mounting the assembly to the inside of headpiece 10 just below perspiration band 18 and for supporting spool reel or shaft 74. The latter is mounted in both ends 76*a*, and 76*b* of the housing for rotational movement. The side of housing 72 is provided with slot 78 which is disposed to receive cord 70. A plurality of holes 80 are disposed in end 76*a* of the housing so that each hole is radially spaced from shaft 74 an equal distance.

The portion of shaft 74 which is disposed within housing 72 is provided with eye or aperture 82 for receiving and holding an end of cord 70. This portion of shaft 74 also includes radially-extending flange portion 83 for holding a coiled spring 84 against the inside of end 76*a* of the housing so that shaft 74 is biased in an axial direction toward end 76*b* of the housing. The outer portion of shaft 74 which extends beyond end 76*a* supports knurled grip 86. The latter is provided with locking pin 88 which extends axially from the grip and is radially spaced from the shaft so that it will engage any one of holes 80 of end 76*a* of the housing depending on the rotational position of the shaft.

Housing 72 and grip 86 are preferably made of the same materials as those described with respect to lever arm 50 and ratchet bar 52 of the FIG. 1 embodiment, while shaft 74, pin 88 and spring 84 are preferably made of a rust-proof metal or metal alloy such as stainless steel, or the like.

The embodiment of FIGS. 4–7 is utilized by adjusting perspiration band 18, and cradle leg straps 22 to provide maximum contact of band 18, straps 22 and 38 as well as crown cushion 24 with the user's head as previously described with respect to the embodiment of FIGS. 1–3. Next, rear strap 64 and two side straps 66 are adjusted so that when nape strap 44 is locked in the tension state, the rear portion of the strap will contact the nape of the neck in a comfortable manner. In order to place spool assembly in the unlocked position knurled grip 86 is moved axially, against the bias of spring 84 so that locking pin 88 disengages the particular hole 80 in which it had last been disposed. While keeping grip 86 against the bias of spring 84 so that pin 88 remains clear of holes 80; grip 86 and shaft 74 of both spool assemblies are rotated about the axis of the shaft so that a sufficient amount of cord 70 is unwound from the shaft to loosen nape strap 44 from the nape of the wearer's neck. Grip 86 is then released so that spring 84 biases shaft 74 toward end 76*b* of the housing and pin 88 engages the closest hole 80 in end 76*a* of the housing. In this unlocked position, headpiece 10 can easily be placed on the head and removed without difficulty. When it is desirable to secure the headpiece so that the suspension is locked on the wearer's head, each grip 86 is again moved axially against the bias of spring 84 so that locking pin 88 disengages the particular hole 80 in which it had last been disposed. While keeping the grip in this axial position, grip 86 and shaft 74 of both spool assemblies are rotated about the axis of the shaft so as to wind a sufficient amount of cord 70 on shaft 74 to place nape strap 44 in a tension state. Grip 86 is then released so that the spring 84 again biases shaft 74 toward end 76*b* of the housing and pin 88 engages the closest hole 80 in end 76*a* of the housing. Since pin 88 is locked in hole 80, nape strap 44 will remain in tension so that the head will be locked in the suspension. In this tensioned and locked state headpiece 10 will be stable on the wearer's head.

Various modifications can be made to the embodiments described herein without departing from the invention. For example, only one tensioning and locking assembly 46 need be employed, with one end of the nape strap being attached to the assembly and the other end of the nape strap being fixedly secured to headpiece 10.

Headgear employing the present invention has several advantages. The supporting system can be made removable from headpiece 10 to facilitate replacement or washing. It provides good ventilation and thus minimizes head perspiration. The supporting system is adjustable to fit most heads. It can be used within the M-1 steel helmet shell and liner and does not appreciably increase the weight of the helmet shell and liner. The system minimizes the production of secondary missiles when the headpiece is penetrated by a projectile. Finally, the supporting system increases the stability of present headgear, by equalized distribution of weight and by minimizing relative motion between the headpiece and the head, while the wearer is in motion or the head is moved suddenly or violently with or without the aid of a chin strap.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a rigid headpiece having an internal suspension for supporting the headpiece in spaced relation to a wearer's head the improvement comprising:

an elongated nape strap disposed adjacent the rear portion of said headpiece for contacting the nape of the wearer's neck, the ends of said strap being disposed adjacent respective sides of said headpiece; and means coupling at least one end of said nape strap to a corresponding side of said headpiece, and comprising variable tension means including at least one lever arm cooperative with a ratchet bar and movable between a first position wherein said nape strap is tensioned and locked in a tensioned state so that said wearer's head can be locked within said headpiece between said suspension and said nape strap and a second position wherein said nape strap is relaxed so that said wearer's head can be easily positioned in and removed from said suspension.

2. In a headpiece according to claim 1, wherein said lever arm is connected at one end to the inside of said headpiece and is pivotally movable about said one end between said first and second positions, and wherein said at least one end of said nape strap is coupled to said lever arm at a point spaced from said one end of said lever arm.

3. In a headpiece according to claim 2, wherein said lever arm and said ratchet bar include interlocking means for locking said lever arm in a plurality of predetermined positions.

4. In a headpiece accordding to claim 3, wherein said interlocking means includes a ratchet tooth provided on said lever arm, said tooth being engagable with a plurality of spaced apart notched recesses provided in said ratchet bar.

5. In a headpiece in accordance with claim 1, wherein said variable tension means comprises a pair of lever arms, each being connected at one of its ends to the inside of said headpiece at a respective side thereof and pivotally movable about said one end between said first and second positions, each of said arms being cooperative with a corresponding ratchet bar, wherein each end of said nape strap is coupled to a corresponding lever arm at a point spaced from said one end of said lever arm.

* * * * *